US006351955B1

(12) United States Patent
Oltman et al.

(10) Patent No.: US 6,351,955 B1
(45) Date of Patent: Mar. 5, 2002

(54) METHOD AND APPARATUS FOR RAPID ICE PRODUCTION

(75) Inventors: Andrew M. Oltman, Evansville, MI (US); Ronald W. Guess; Martin R. Busche, both of Evansville, IN (US); Keith A. Snyder, Evansville, OH (US); Dennis G. Schenk, Wadesville, IN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 09/628,820

(22) Filed: Jul. 31, 2000

(51) Int. Cl.[7] ..... F25C 1/12
(52) U.S. Cl. ..... 62/71; 62/353
(58) Field of Search ..... 62/71, 73, 351, 62/353

(56) References Cited

U.S. PATENT DOCUMENTS 3,055,186 A * 9/1962 Linstromberg et al. ..... 62/353
3,126,714 A * 3/1964 Zuercher, Jr. ..... 62/353
3,146,606 A * 9/1964 Grimes et al. ..... 62/351
3,182,464 A * 5/1965 Archer ..... 62/353
3,270,519 A * 9/1966 Pohl, Jr. ..... 62/353
3,382,682 A * 5/1968 Frohbieter ..... 62/353
3,541,806 A * 11/1970 Jacobs ..... 62/351
4,727,720 A * 3/1988 Wernicki ..... 62/353
4,756,165 A 7/1988 Chestnut et al. ..... 62/135
4,799,362 A 1/1989 Chesnut ..... 62/127

* cited by examiner

*Primary Examiner*—William E. Tapolcai
(74) *Attorney, Agent, or Firm*—Stephen Krefman; Robert O. Rice; Joel M. Van Winkle

(57) ABSTRACT

An ice maker for use in a refrigeration apparatus as well as a method of optimizing ice production in an ice maker. The ice maker has a mold and a fan selectively operable to direct moving cold air past the mold during the ice formation process. In the preferred embodiment, the fan does not operate during the harvest portion of the cycle. A fan assembly consisting of a fan or blower, a motor, a switch in series with the motor and leads for electrically interconnecting the motor and in switch with the icemaker power supply is preferably assembled as a module removably interconnectable with the icemaker as an optional feature. The icemaker has an increased the rate of ice production due to the increased rate of convective heat transfer.

18 Claims, 7 Drawing Sheets

METHOD AND APPARATUS FOR RAPID ICE PRODUCTION

BACKGROUND OF THE PRESENT INVENTION

The present invention relates to ice makers within enclosed freezer compartments of refrigeration appliances and more particularly to a method of enhancing the ice production of such ice makers.

The present invention is directed to improvements in the type of icemakers exemplified by those disclosed in U.S. Pat. Nos. 4,756,165 and 4,799,362, owned by the assignee of the present invention, wherein an ice mold and associated ice maker mechanism are mounted in the freezer compartment of a domestic combination refrigerator/freezer apparatus. The ice maker includes a mold in which water is frozen to form a plurality of ice bodies. An electric motor rotates the mold when the ice has formed. An electric heater in heat transfer association with the mold frees the ice bodies from the mold and the ice bodies are ejected from the mold. The ice maker includes a control circuit with a thermostat responsive to the temperature of water in the mold. A thermostat switch is controlled by the thermostat to initiate and terminate operation of the ice maker motor for ejecting the ice body upon complete freezing thereof and concurrently energizing the heater.

In domestic combination refrigerator/freezers, the rate at which a component ice maker located in the freezer compartment can make ice is limited by the fact that the evaporator fan cycles on and off with the compressor. During the "off-cycle", which can be as much as 70% of the time depending on ambient conditions, the rate of heat removal from the ice maker mold is drastically reduced compared to the "on-cycle" due to the loss of the forced air convection. Since the air within the freezer is controlled to be significantly below freezing during the "off-cycle", what is required to maintain the efficient and rapid rate of ice production that is available during the "on-cycle" is to provide a means to keep the air moving over the mold. Running the evaporator fan during this period may not be desirable, since it would normally draw air from the refrigeration compartment past the evaporator and into the freezer compartment, warming both.

In fact, it has been experimentally observed that the rate of ice production in domestic combination refrigerator freezers with these and similar ice makers is greatly affected by the ambient temperature of the room. More particularly, when the room is warmer, it has been observed that the compressor operates more frequently and that the ice making production rate increases. It has been experimentally determined by the present inventors that the rate of ice production is directly and drastically influenced by the amount of airflow across the ice forming components of the ice maker.

Therefore, what is needed to obtain a reliable optimal ice production rate is to provide for sufficient airflow across the ice maker during ice making regardless of the ambient temperature.

In U.S. Pat. No. 4,799,362 there is further disclosed an ice maker similar to the one described in U.S. Pat. No. 4,756,165 but modified to provide pre-selected circuit test probe points for cooperation with a test apparatus for testing the operating condition of components of the ice maker. The test probe points allow inspection during manufacture or maintenance of the operation of the icemaker.

It would be advantageous to use test probe points of this type for the dual purpose of monitoring the operation of the icemaker to determine when airflow should be increased to provide optical ice production.

SUMMARY OF THE PRESENT INVENTION

The present invention is directed to a method and apparatus for improved ice production within a freezer or within the freezer compartment of a combination refrigerator/freezer. The present invention improves the rate of ice production by providing a fan selectively operable to direct cooled air across the ice making surfaces of the ice maker during the ice formation process.

In one embodiment of the present invention, a fan or blower is disposed at the rear of the freezer compartment and is selectively operable to direct air from the freezer compartment forward towards and across the ice forming components of the ice maker apparatus.

In a second embodiment of the present invention, a fan or blower, is mounted to a forward portion of the ice making apparatus and is selectively operable to direct air rearwardly towards and across the ice forming components of the ice making apparatus.

In the second embodiment, the fan or blower is part of a fan assembly selectively and removably mountable to the ice maker assembly an optional feature.

In either embodiment, the fan assembly preferably takes power off of pre-selected power test connection points on the ice maker which supply power when the ice maker is in the ice forming portion of its cycle.

In either embodiment, the fan is preferably selectively operable to run only when the ice maker is powered to make ice and does not operate during ice harvest.

It is therefore an object of the present invention to provide an ice maker having an optimized rate of ice production regardless of ambient conditions. It is another object of the present invention to provide an upgrade module for an ice maker such that it may be provided in a conventional configuration or, by interconnecting the upgrade module, in an optional high ice production configuration. It is yet another object of the present invention to provide an ice maker having a means to increase air flow across the mold at times selected to produce optimized production ice where such times are determined by monitoring preselected ice maker control circuit test points indicative of such preselected times.

It is still another object of the present invention to provide a method of optimizing ice production in an ice maker in a refrigeration device by increasing air flow across the mold at preselected times independent of ambient room conditions. It is another object of the present invention to provide a method of optimizing ice production in an ice maker in a refrigeration device by increasing air flow across the mold at times selected to produce optimized production ice where such times are determined by monitoring preselected icemaker control circuit test points indicative of such preselected times.

These and the many objects and advantages of the present invention will become apparent to those skilled in the art from the following detailed description of the present invention in conjunction with the accompanying drawings.

BRIEF DESCRIPTION OF THE DRAWINGS

In the appended drawings, wherein like reference numerals refer to like components throughout.

DETAILED DESCRIPTION OF THE PREFERRED EMBODIMENTS

Figure 1:
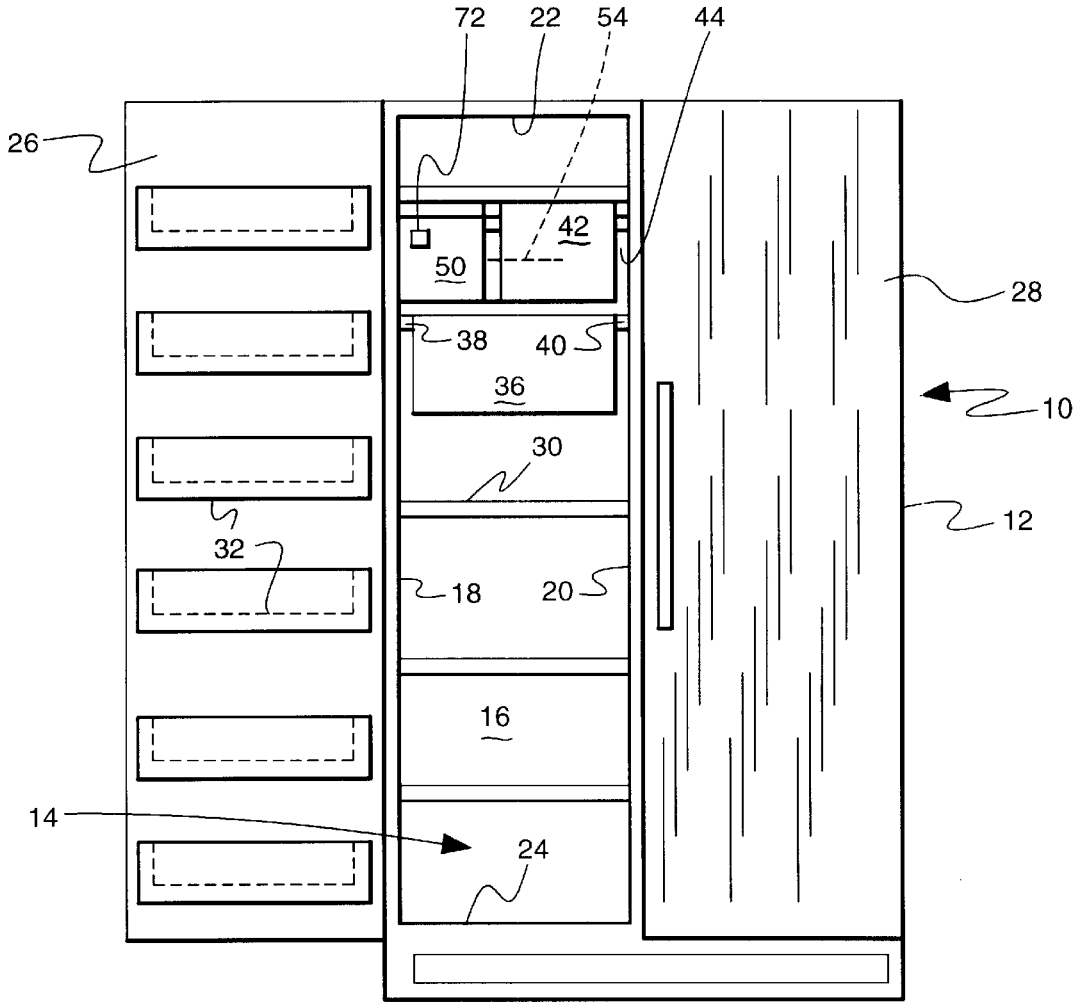
FIG. 1 is a front elevation view of a combination refrigerator freezer having a first embodiment of an ice maker assembly and an ice maker fan assembly according to the present invention in the freezer compartment thereof.

The present invention relates to ice makers for freezers and combination refrigerator/freezer appliances and more particularly to a method of enhancing the ice production of such ice makers. In particular, the present invention provides an improved method and apparatus for the delivery of moving cool air to the ice making components of an ice maker such as to increase the rate of ice production by increasing the rate of connective heat transfer.

The detailed description and in the drawings forming a part of this patent specification, the present invention is described in connection with ice making apparatus of the time illustrated and described in U.S. Pat. No. 4,756,165 invented by Paul B. Chestnut and Ronald W. Guess ("Guess '165") and the test apparatus for an ice making apparatus illustrated and described in U.S. Pat. No. 4,799,362, invented by Paul B. Chestnut ("Chestnut '362), the contents of which are hereby incorporated by reference into the present application.

While use of the present invention in connection with the ice making and test apparatus of Guess '165 and Chestnut '362, which constitutes the best mode contemplated by the inventors for carrying out the present invention at the time of filing the present application, it should be understood that the present invention is believed to be applicable generally to any ice making apparatus having an ice mold located in the freezer compartment of a refrigeration appliance and therefore the claims appended hereto are not intended to be limited to this configuration.

Referring now to the drawings and more particularly to FIG. 1, a refrigeration apparatus such as a refrigerator 10 has a cabinet 12 having a freezer compartment 14 defined by a back wall 16, pair of sidewalls 18 and 20, a top wall 22, a bottom wall 24. The freezer compartment is selectively enclosed in normal operation by a freezer door 26. The refrigerator 10 further has a fresh food compartment, not visible in the drawing but well known in the art, which is similarly selectively enclosed during normal operation by a refrigerator door 28.

In the example illustrated, the refrigerator 10 is a side by side combination refrigerator/freezer, but it the icemaker and method of the present invention could function equally effectively in a top mount refrigerator/freezer of the type illustrated in Chestnut '362 or in a chest freezer or upright freezer, as are well known in the art.

The refrigerator 10 has a power supply, a cooling system, an air distribution system and a refrigerator control system, not illustrated but well known in the art. As shown schematically in FIG. 7, the refrigerator control system 112 obtains power from the power supply 114 and is adapted to control the operation of the cooling system and air redistribution system so as to maintain the refrigeration compartment and the freezer compartment 14 approximately at preselected respective temperature levels.

The freezer compartment 14 has a plurality of interior shelves 30 mounted to the side walls 18 and 20 as well as door shelves 32 for the storage of food items.

The freezer compartment further has an ice maker assembly 34 mounted to one of the sidewalls 18. An ice bin 36 is slideably and removably mounted within the freezer compartment 14 below the ice maker assembly 34 on guides 36, 38 and 40 mounted to the sidewalls 16 and 18. A garage door panel 42 is typically pivotally mounted to the sidewall 18 and the ice maker assembly 34. The garage door panel 42 is pivotable between a raised and horizontal position illustrated in FIG. 2 and a lowered and vertical position illustrated in FIG. 1 enclosing the region 44 above the ice bin 36 which is not occupied by the ice maker assembly 34.

Figure 2:
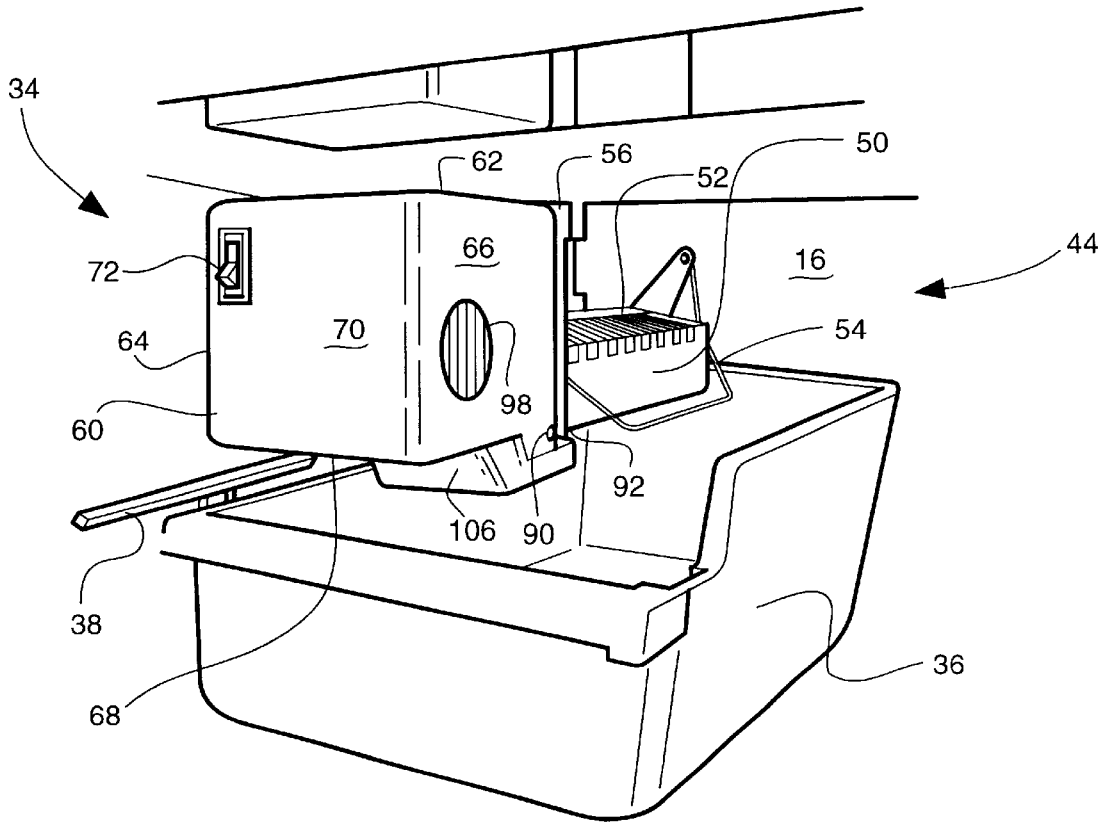
FIG. 2 is an enlarged front perspective view of the ice maker assembly of FIG. 1 and a portion of the freezer compartment.
Figure 3:
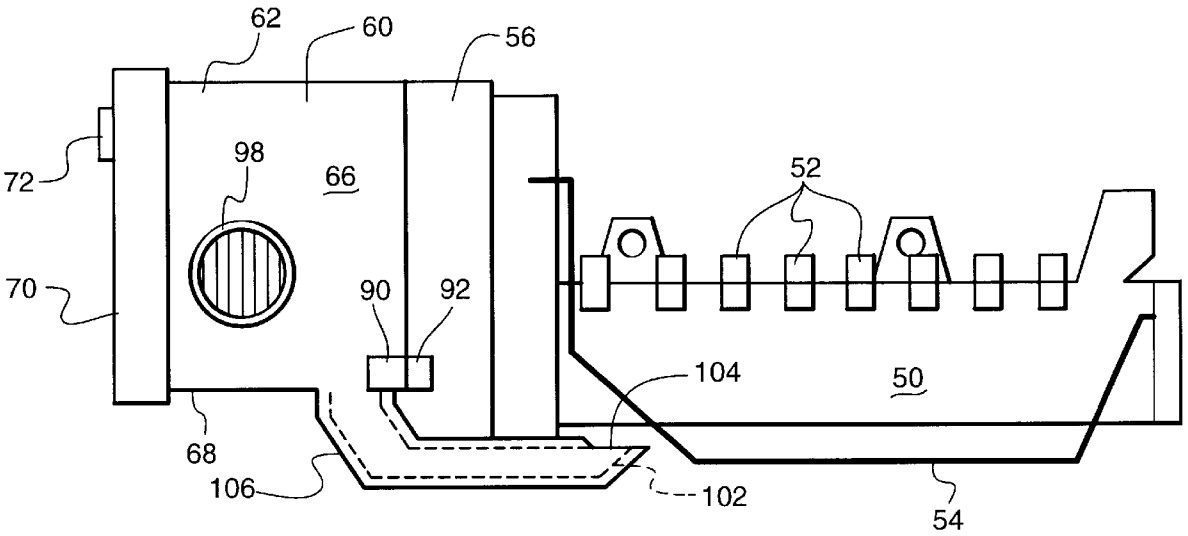
FIG. 3 is a side elevational view of the icemaker assembly of FIGS. 1 and 2 showing certain features of the ice maker apparatus and the fan assembly thereof.

Referring to FIGS. 2 and 3, the icemaker assembly 34 includes an ice making apparatus 50 having a plurality of molds 52 in which ice bodies are formed. As is well known in the art and therefore not shown in the drawing or described herein in detail, the ice maker assembly 34 includes water delivery system for periodically supplying water to the molds 52, a heater for heating the molds 52 a motor for moving the mold, typically by rotation, from an ice forming orientation to an ice delivery orientation, a heater for heating the mold to facilitate the separation of the ice bodies, and ice ejection apparatus for ejecting the ice bodies from the mold and permitting them to fall into the ice bin 36. Further, as is well known in the art and therefore not shown in the drawing, an ice maker control circuit controls the operation of the water delivery system, the motor, the heater, and the ejection apparatus to regulate the production of ice bodies and delivery of the ice bodies to the ice bin 36 when the ice maker assembly is operating. An exemplary ice making apparatus 50 is shown and described in structural and operational detail in Guess '165.

A bin lever arm 54 is pivotally mounted to the housing of the ice maker assembly 34 such as to pivot between a lowered position disposed partially within the ice bin 36 and raised positions disposed significantly above the ice bin 34. As is well known, the bin lever arm operates a switch, not shown, operable to cause the ice maker control circuit to halt the production of by the ice making apparatus 50 when the bin lever arm is pivoted above a preselected height relative to the ice bin 36 whereby, as ice bodies are added to the ice bin, the bin lever arm is raised by the ice bodies until the bin lever arm reaches the preselected height whereupon ice production ceases.

Figure 3A:
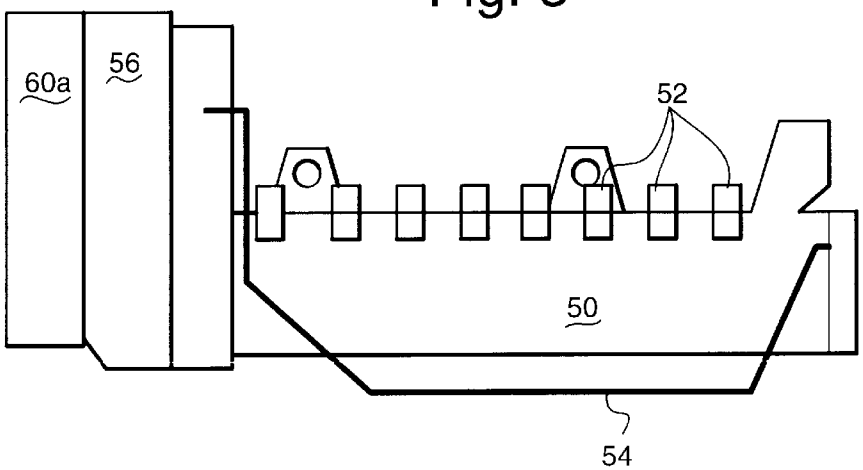
FIG. 3A is a partial side elevational view of the ice maker assembly of FIGS. 1 and 2, but with a conventional cover replacing the fan assembly thereof.
Figure 4:
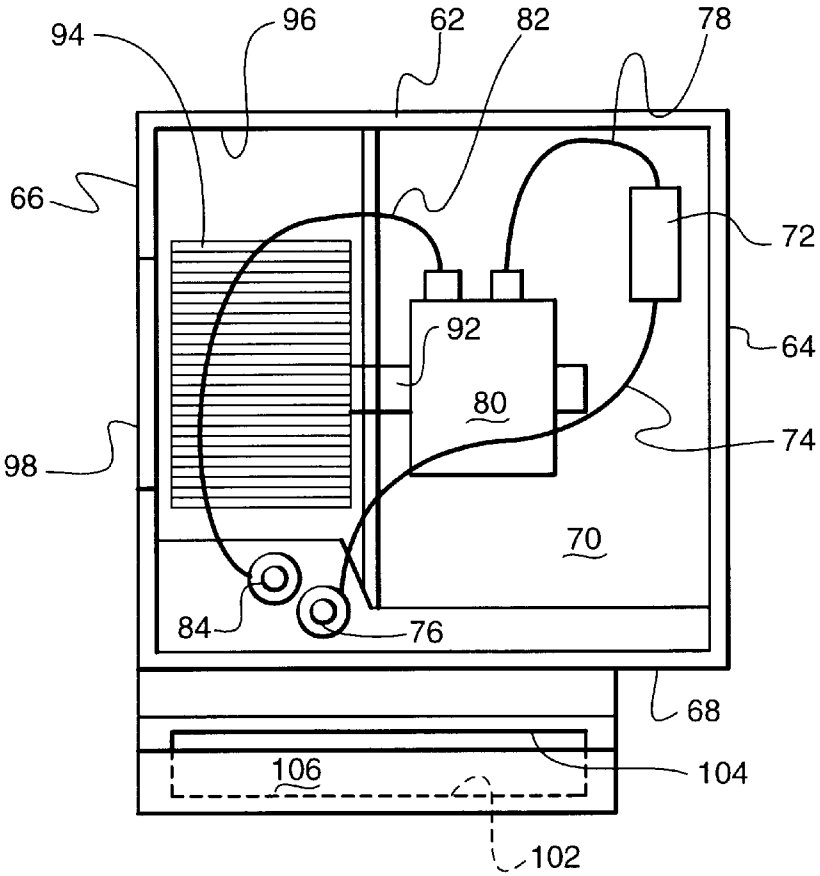
FIG. 4 is a rear elevation view of the fan assembly of FIG. 3.

Referring to FIGS. 3 and 4, in the preferred embodiment of the present invention, the ice maker assembly 34 includes a tool removable fan assembly 60 attached to the front face 56 of the housing of the ice maker assembly. The fan assembly 60 is preferably a modular unit containing all of the components, as described hereinbelow, required to provide timed increased airflow to the ice making apparatus such as to produce an optimal ice production rate. Providing a modular design for the fan assembly 60 allows an ice maker to be assembled without the fan assembly and instead using an alternate end decorative and safety cover 60*a,* shown in FIG. 3A and similar to the cover shown in FIG. 1 of Guess '165. This permits efficient simultaneous production of both a conventional ice maker assembly such as that shown in Guess '165 and a high production ice maker assembly 34. The modular design further permits the fan assembly 60 to be offered commercially as an optional upgrade to certain conventional ice maker assemblies.

The fan assembly 60 has a housing, preferably formed of a suitable plastic material, having a top wall 62, a side wall 64, a side wall 66, a bottom wall 68, and a front wall 70. The fan assembly 60 is removably mounted to the front face 56 of the housing of the ice maker assembly 34 by means of cooperating mounting structures 90 and 92 of the front face of ice maker assembly and the fan assembly, respectively. Preferably, the cooperating mounting structures require a tool for removal to inhibit removal except by repair technician. When removably mounted to the front face 56 of the housing of the ice maker assembly 34, the top wall 62, bottom wall 68, and side walls 64 and 66 are substantially aligned with the outer dimensions of the ice maker assembly 34, and substantially blocks the ice maker assembly, except for the bin lever arm 54, from elevation view by a user of the freezer compartment 14.

Figure 7:
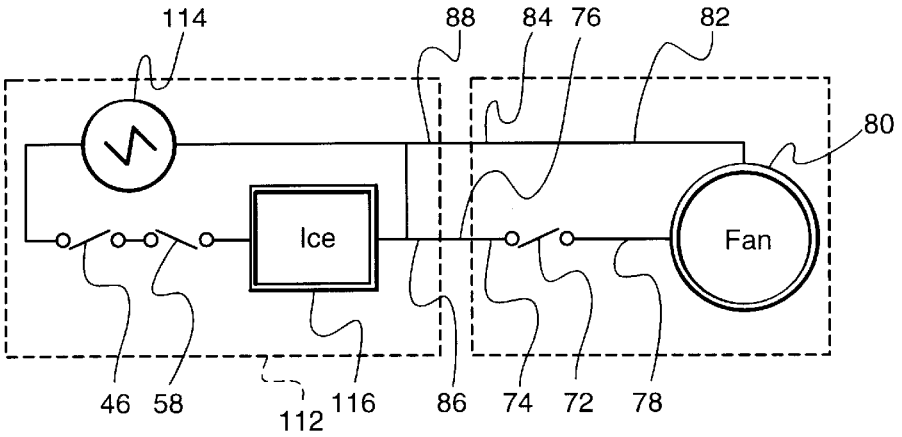
FIG. 7 is a schematic wiring diagram illustrating the method and apparatus for controlling the fan assemblies of FIGS. 1 through 5.

As best shown in FIGS. 4 and 7, a fan switch 72 is mounted to the front wall 70 of the fan assembly for selective operation of the fan assembly in a manner described later herein. One pole of the switch 72 is connected within the housing of the fan assembly 60 by a wire 74 to a first pin 76 projecting rearwardly from the fan assembly and adapted for selective electrical engagement with the ice maker control circuit 116 of the ice maker assembly 34 in a manner to be described shortly. Another pole of the switch 72 is connected by a wire 78 to one pole of a fan motor 80. The second pole of he fan motor is connected by a wire 82 to a second pin 84 projecting outwardly and rearwardly from the interior of the fan assembly 60 and adapted for selective electrical engagement with the ice maker control circuit 116 of the ice maker assembly 34.

Figure 6:
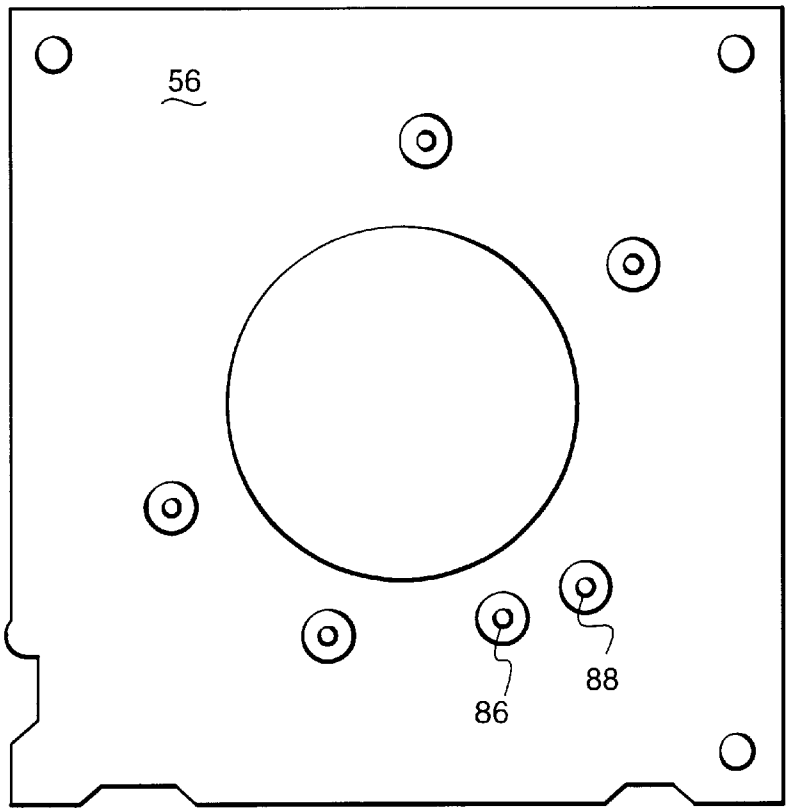
FIG. 6 is a front elevational view of the ice maker assembly of FIG. 3 with the fan assembly removed.

As shown schematically in FIG. 7, the first and second pins 76 and 84 are designed to engage mechanically and electrically with respective connection points 86 and 88 on the front face 56 of the housing (See also FIG. 6) of the ice maker assembly 34 such as to place the fan motor 80 and the fan switch 72 in series with main switch 46 of the ice control circuit. Thus, the fan motor 80 will only operate when both the ice making apparatus 50 is operating to make ice and the fan switch is set to permit the fan motor to operate. Preferably, as shown in FIG. 7, the fan motor 80 is also in series with the bail arm switch 58 so that it will cease operating when the bail arm is raised. This is preferred because, as is well known in the art, the bail arm is raised when the ice maker is in a harvesting mode and the heater is operated to loosen the ice bodies from the molds 52. It is less efficient to provide air movement across the molds during harvest because it disperses the heat that is intended to be focused on separating the ice bodies and thereby interferes with the process and unnecessarily adds heat to the freezer compartment.

Referring back to FIG. 4, the fan motor 80 drives a shaft 92 coupled to a blower wheel 94 rotatably disposed with an enclosure 96 formed within the housing of the fan assembly 60 adjacent the side wall 66 adjacent the open region 44 above the ice storage bin 36. An air inlet aperture 98 is provided into the enclosure 96 through the side wall 66. The air inlet aperture 98 has a openings of a preselected configuration, size and shape suitable to permit sufficient airflow while minimizing the risk of damage or unintentional entry of objects. It is critical that the air inlet apertures 98 be clear of obstructions. Thus, in both embodiments described herein, the inlet is placed toward the inside of the product above the ice to minimize the chance obstruction.

The fan assembly 60 is further provided with an elongated snout 106 extending from the bottom wall 68 rearwardly and downwardly towards the region below the molds 52 and providing therein a passageway 102 communicating at one end with the enclosure 96 and at the other end with an outlet aperture 104 adjacent and below the molds 52 such that, when the fan motor 60 is operating, the blower wheel draws air through the inlet aperture 98 and delivers it out the outlet aperture 104 to the molds 52. The snout 96 extends substantially along the entire width of the bottom wall 68 so as to provide an elongate outlet aperture 104 except that it is designed to clear the guide 38 and side wall of the ice storage bin 36.

Figure 5:
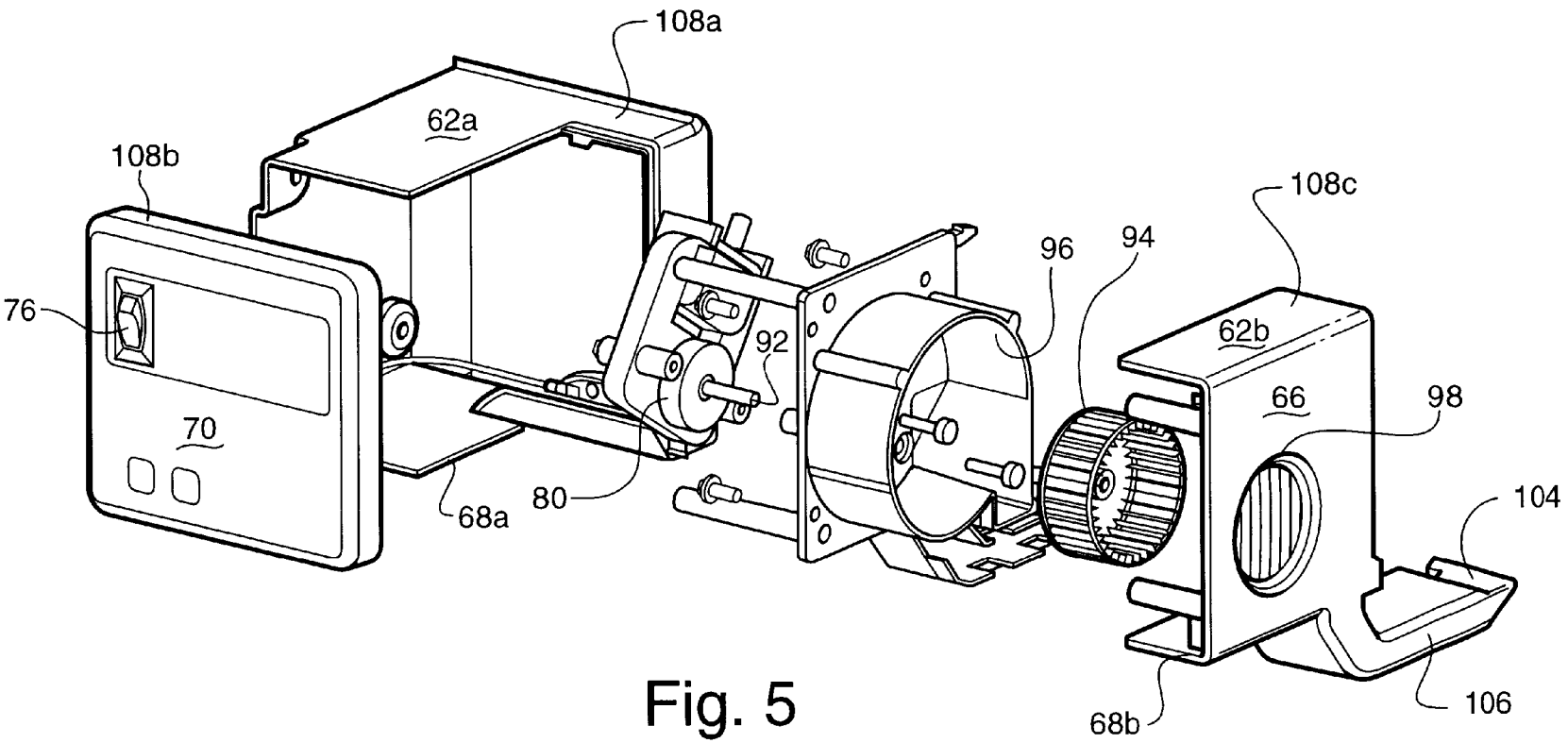
FIG. 5 is an exploded view of the fan assembly of FIGS. 3 and 4.

FIG. 5 shows a preferred method of constructing the fan assembly 60 by constructing the housing from three frame members 108*a,* 108*b* and 108*c*.

Figure 9:
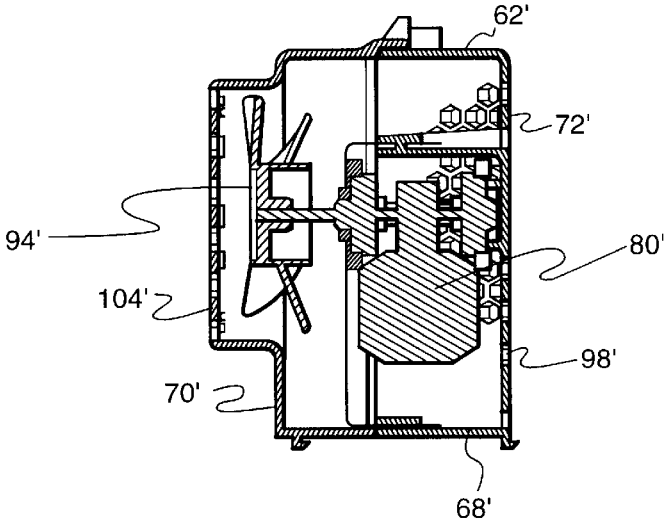
FIG. 9 is a cutaway side view of the fan assembly of FIG. 8.
Figure 8:
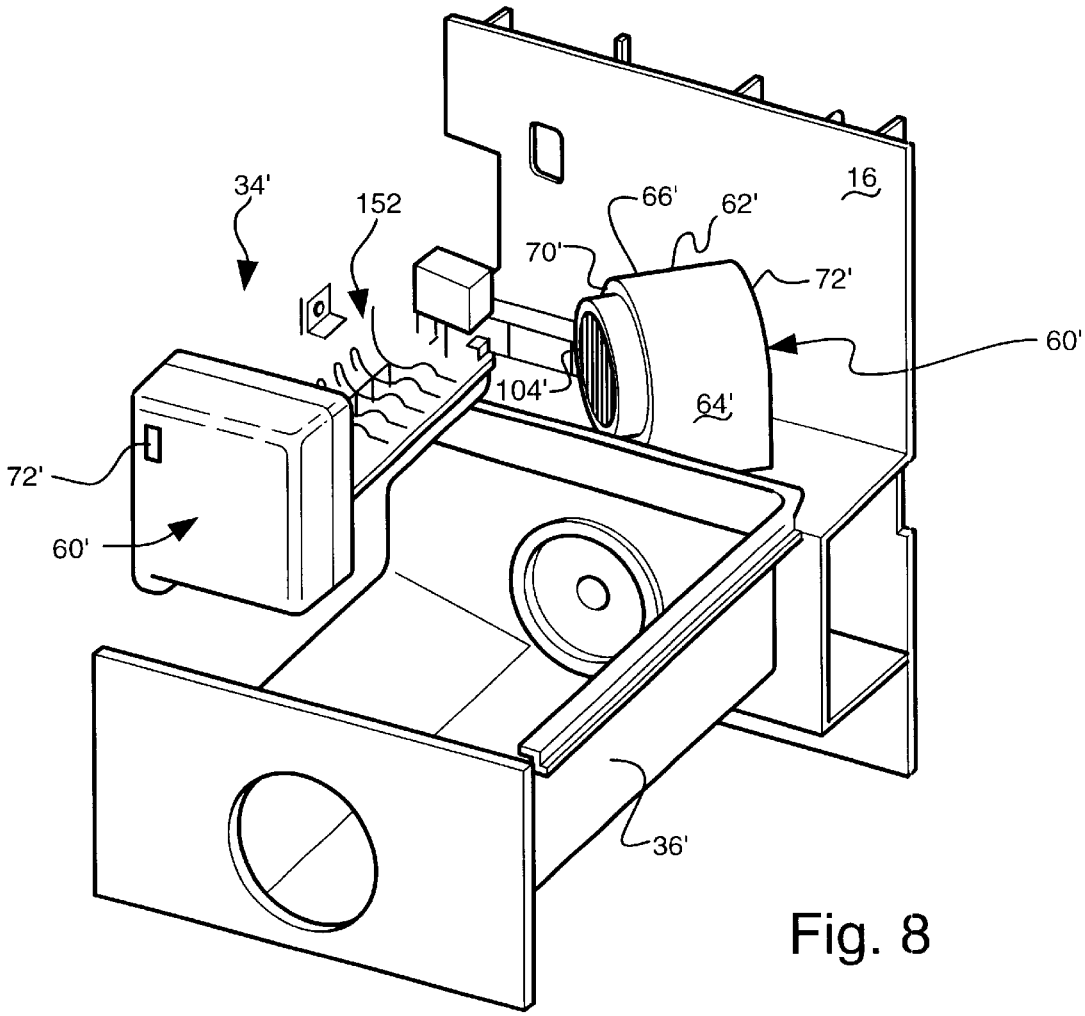
FIG. 8 is an enlarged front perspective view of an ice maker assembly and a portion of a freezer compartment similar to FIG. 1 but illustrating a second embodiment of the fan assembly according to the present invention.

Referring now to FIGS. 8 and 9, an alternate ice maker assembly 34' is illustrated wherein an alternate fan assembly 60' is provided at the rearward portion of the open region 44 such as to selectively direct a flow of forward and towards the molds 152. In this embodiment, the fan assembly 60' has a top wall 62', a side wall 64', a side wall 66', a bottom wall 68', a front wall 70' and a rear wall 72'. A conventional axial fan, 94' driven by a motor 80' draws air through an appropriate inlet aperture 98' in the rear wall 72' and pushes it out through a suitable outlet aperture 104' in the front wall 70'. A fan switch 72' and first and second pins 76' and 84' are provided on the cover 60' and are electrically connected to the fan in a manner similar to that shown schematically in FIG. 7 by wires, not shown, disposed within the freezer walls in a manner well known in the art. FIG. 8 also schematically illustrates an ice bin 36' of the type well known in the art adapted for cooperation with an ice dispensing mechanism through the freezer door 26.

Please note that in both embodiments described herein, the air is supplied to the bottom of the ice maker assembly 34 and 34' to prevent voids in the ice bodies. This also allows the air in the water to escape through the top of the ice bodies prior to freezing and gives a better "ice cube" without voids, cracks and improves clarity. Please also note that the air should not be supplied to near the bi-metal switch as it will cause the ice maker to cycle prematurely and could cause voids and cracks in the ice body to occur. Maximum efficiency occurs when air is supplied to the ice body next to the bi-metal switch and directed away from the bi-metal switch. The snout 106 of the preferred embodiment was designed to function as a nozzle in order to direct the airflow to this precise location, which can vary between ice maker designs.

The fan assembly of the present invention has been shown in use to produce and increase of 40 to 80% in the number of ice production cycles and therefore the number of cubes and the weight of ice produced daily, depending on the design of the refrigerator and the ambient conditions.

When incorporating the present invention into an existing refrigerator design, it must be appreciated that a higher rate of ice production means that a large capacity compressor may be needed to handle the additional heat load from, cooling the extra water into ice, operating the fan motor, and increasing the use of the ice maker heater.

The above description includes the best mode contemplated by the inventors for carrying out the present invention and is not intended to limit the scope of the invention to the specific example illustrated except where explicitly stated herein or in the claims. What is claimed as novel is as follows.

We claim:

1. An ice making apparatus adapted for installation in a freezer compartment of an refrigeration appliance, said ice making apparatus comprising:

a mold, water supply means adapted to supply water to said mold, whereby said water freezes in said mold due to exposure to below freezing conditions in said freezer compartment, means for ejecting an ice body from the mold, control means for controlling the operation of said ice making apparatus, a fan assembly comprising:

a fan, a fan motor in driving engagement with said fan, said fan motor being selectively operable to direct moving air across said mold when in response to said control means when said ice making apparatus is making ice, and a user operable switch to selectively shut off or permit operation of said fan motor, said fan motor only operating when both said user operable switch is closed and said ice maker is operating.

2. An ice making apparatus adapted for installation in a freezer compartment of an refrigeration appliance, said ice making apparatus comprising:

a mold, water supply means adapted to supply water to said mold, whereby said water freezes in said mold due to exposure to below freezing conditions in said freezer compartment, means for ejecting an ice body from the mold, control means for controlling the operation of said ice making apparatus, a fan assembly comprising:

a fan, a fan motor in driving engagement with said fan, said fan motor being selectively operable to direct moving air across said mold when in response to said control means when said ice making apparatus is making ice, a user operable switch to selectively shut off or permit operation of said fan motor, said fan motor only operating when both said user operable switch is closed and said ice maker is operating, and switching means to terminate power to the fan motor during an ice harvest operation.

3. The ice maker of claim 2 further comprising a thermal switch adapted to distinguish between the presence of liquid water and the presence of ice in said ice maker and further wherein said switching means terminates power to said fan motor when said thermal switch indicates a temperature below a predetermined set temperature indicative of the presence of ice.

4. An ice making apparatus adapted for installation in a freezer compartment of an refrigeration appliance, said ice making apparatus comprising:

a mold, water supply means adapted to supply water to said mold, whereby said water freezes in said mold due to exposure to below freezing conditions in said freezer compartment, means for ejecting an ice body from the mold, control means for controlling the operation of said ice making apparatus, a selectively and removably mountable fan assembly mountable adjacent to said ice making apparatus so as to be capable of field installation as an optional upgrade to improve ice production comprising:

a fan, a fan motor in driving engagement with said fan, said fan motor being selectively operable to direct moving air across said mold when in response to said control means when said ice making apparatus is making ice, wherein said fan assembly is mounted to the forward side of said ice maker assembly such to enclose the front of said ice maker assembly.

5. The ice maker assembly of claim 4 wherein said fan assembly further comprises connector leads selectively engageable with preselected test leads on said forward side of said ice maker such as to electrically interconnect said fan motor with said power supply when said ice maker is operating.

6. An ice making apparatus adapted for installation in a freezer compartment of an refrigeration appliance, said ice making apparatus comprising:

a mold, water supply means adapted to supply water to said mold, whereby said water freezes in said mold due to exposure to below freezing conditions in said freezer compartment, means for ejecting an ice body from the mold, control means for controlling the operation of said ice making apparatus, a fan assembly mounted to the forward side of said ice maker assembly such to enclose the front of said ice maker assembly comprising:

a fan, a fan motor in driving engagement with said fan, said fan motor being selectively operable to direct moving air across said mold when in response to said control means when said ice making apparatus is making ice, and connector leads selectively engageable with preselected test leads on said forward side of said ice maker assembly such as to electrically interconnect said fan motor with said power supply when said ice maker is operating, wherein said connector leads are automatically engaged and interconnected with said test leads when said housing of said fan assembly is interconnected with said ice making assembly.

7. The ice maker of claim 6 further comprising a user operable switch connected in series with said fan motor and said connector leads such that said fan motor is only powered when both said user operable switch is closed and said ice maker is operating.

8. The ice maker of claim 6 wherein said test leads do not supply power to said fan motor when said ice maker assembly is in the harvest portion of an ice making cycle.

9. An ice making apparatus adapted for installation in a freezer compartment of an refrigeration appliance, said ice making apparatus comprising:

a mold, water supply means adapted to supply water to said mold, whereby said water freezes in said mold due to exposure to below freezing conditions in said freezer compartment, means for ejecting an ice body from the mold, control means for controlling the operation of said ice making apparatus, a selectively and removably mountable fan assembly mountable adjacent to said ice making apparatus so as to be capable of field installation as an optional upgrade to improve ice production comprising:

a fan, a fan motor in driving engagement with said fan, said fan motor being selectively operable to direct moving air across said mold when in response to said control means when said ice making apparatus is making ice, wherein said fan assembly is located rearwardly and is disposed such as to direct air generally horizontally forward towards and across the bottom of said mold.

10. The ice maker of claim 9 wherein said fan assembly is mounted to a rear wall of the freezer compartment.

11. A method of making ice comprising the steps of:

chilling a compartment to a preselected temperature below the freezing temperature of water, disposing within said compartment an ice making apparatus having a mold, adding water to said mold, blowing air across said mold regardless of ambient conditions in said compartment, detecting when said water has frozen into an ice body in said mold, ejecting said ice body from said mold into an ice bin disposed within said ice making apparatus, detect whether there is a continuing demand for ice, returning to said step of adding water if there is a demand for ice, and stopping said step of blowing air and returning to said step of detecting if there is no demand for ice.

12. A method of claim 11 wherein said step of blowing air further comprises blowing air provided a user operated switch is in the operating position.

13. A method of making ice comprising the steps of:

chilling a compartment to a preselected temperature below the freezing temperature of water, disposing within said compartment an ice making apparatus having a mold, adding water to said mold, blowing air across said mold regardless of ambient conditions in said compartment, detecting when said water has frozen into an ice body in said mold, ejecting said ice body from said mold into an ice bin disposed within said compartment, detecting when said water has frozen into an ice body in said mold, ejecting said ice body from said mold into an ice bin disposed within said ice making apparatus, detecting whether there is a continuing demand for ice, returning to said step of adding water if there is a demand for ice, and stopping said step of blowing air and returning to said step of detecting if there is no demand for ice, wherein said step of blowing air further comprises blowing air across said mold as long as there is a demand for ice except during said step of ejecting said ice body.

14. A selectively and removably mountable fan module for an ice making apparatus adapted for installation in a freezer compartment of an refrigeration appliance, said ice making apparatus having a mold, water supply means adapted to supply water to said mold, whereby said water freezes in said mold due to exposure to below freezing conditions in said freezer compartment, means for ejecting an ice body from the mold, a main power line supplying electrical power to said ice making apparatus, and ice maker control means for controlling the operation of said ice making apparatus and supplying power to said main power line when ice is demanded, said fan module being mountable to said ice making apparatus so as to be capable of field installation as an optional upgrade to improve ice production and comprising:

a fan, a fan motor in driving engagement with said fan, mechanical connection means for connecting said fan module to said ice making apparatus such as to direct the output of said fan towards said mold, and electrical connection means selectively for interconnecting said fan motor in series with said main power line such that said fan module is selectively operable to direct moving air across said mold in response to said control means when detecting demand for ice.

15. The fan module of claim 14 wherein said fan assembly is located forward of said ice forming components and is disposed such as to direct air generally horizontally and rearwardly towards and across the bottom of said mold.

16. The module of claim 14 wherein said ice maker control has test leads for testing the operational status of electrical components of said ice making apparatus, said fan module further comprising connector leads selectively engageable with preselected test leads on said ice maker control such as to electrically interconnect said fan motor with said main power line when said ice making apparatus is operating.

17. A fan module for an ice making apparatus adapted for installation in a freezer compartment of an refrigeration appliance, said ice making apparatus having a mold, water supply means adapted to supply water to said mold, whereby said water freezes in said mold due to exposure to below freezing conditions in said freezer compartment, means for ejecting an ice body from the mold, a main power line supplying electrical power to said ice making apparatus, and ice maker control means for controlling the operation of said ice making apparatus and supplying power to said main power line when ice is demanded, said fan module comprising:

a fan, a fan motor in driving engagement with said fan, mechanical connection means for connecting said fan module to said ice making apparatus such as to direct the output of said fan towards said mold, electrical connection means selectively for interconnecting said fan motor in series with said main power line such that said fan module is selectively operable to direct moving air across said mold in response to said control means when detecting demand for ice, and a user operable switch to selectively shut off or permit operation of said fan motor, said fan motor only operating when both said user operable switch is closed and said ice maker control detects demand for ice.

18. A fan module for an ice making apparatus adapted for installation in a freezer compartment of an refrigeration appliance, said ice making apparatus having a mold, water supply means adapted to supply water to said mold, whereby said water freezes in said mold due to exposure to below freezing conditions in said freezer compartment, means for ejecting an ice body from the mold, a main power line supplying electrical power to said ice making apparatus, and ice maker control means for controlling the operation of said ice making apparatus and supplying power to said main power line when ice is demanded, said fan module comprising:

a fan, a fan motor in driving engagement with said fan, mechanical connection means for connecting said fan module to said ice making apparatus such as to direct the output of said fan towards said mold, electrical connection means selectively for interconnecting said fan motor in series with said main power line such that said fan module is selectively operable to direct moving air across said mold in response to said control means when detecting demand for ice, and switching means to terminate power to the fan motor during an ice harvest operation.

* * * * *